US005226996A

United States Patent [19]

Schober

[11] Patent Number: 5,226,996

[45] Date of Patent: Jul. 13, 1993

[54] METHOD FOR MOUNTING ARTWORK AND THE LIKE ON SUPPORT MEDIUM

[75] Inventor: Vicki Z. Schober, Whitefish Bay, Wis.

[73] Assignee: Vicki Schober Company, Inc., Milwaukee, Wis.

[21] Appl. No.: 965,539

[22] Filed: Oct. 23, 1992

Related U.S. Application Data

[60] Continuation of Ser. No. 683,332, Apr. 10, 1991, abandoned, which is a division of Ser. No. 527,709, May 18, 1990, abandoned, which is a continuation of Ser. No. 363,471, Jun. 8, 1989, abandoned.

[51] Int. Cl.[5] ..... B31F 1/00

[52] U.S. Cl. ..... 156/226; 156/247; 40/158.1

[58] Field of Search ..... 40/156, 158.1, 159.1, 40/359, 360, 594; 248/205.3, 451; 29/462; 156/211, 212, 214, 216, 249, 257, 71, 227, 226, 247

[56] References Cited

U.S. PATENT DOCUMENTS

| | | | |
|---|---|---|---|
| 2,292,176 | 8/1942 | Tate | 40/159.1 |
| 2,292,582 | 8/1942 | Tate | 40/159.1 X |
| 2,534,919 | 12/1950 | Lartz | 40/159.1 |
| 2,825,166 | 3/1958 | Flood | 40/159.1 |
| 3,256,979 | 6/1966 | Tschentschel | 40/159.1 X |
| 3,346,979 | 10/1967 | Milos | 40/159.1 |

*Primary Examiner*—Kenneth J. Dorner
*Assistant Examiner*—Brian K. Green
*Attorney, Agent, or Firm*—Michael, Best & Friedrich

[57] ABSTRACT

The mount for removably supporting art work, photographs and similar articles on a support medium includes an elongated strip of heavyweight, non-acidic paper which has an elongated score line dividing the strip into a stationary section and a foldable section. The stationary section has a film of adhesive covered by a peel-off sheet for securing the stationary section to a support medium. The foldable section is folded over toward the stationary section to form a pocket for firmly receiving a peripheral portion of the article.

6 Claims, 1 Drawing Sheet

METHOD FOR MOUNTING ARTWORK AND THE LIKE ON SUPPORT MEDIUM

This is a continuation of application Ser. No. 683,332, filed Apr. 10, 1991, now abandoned, which is a division of application Ser. No. 527,709, filed May 18, 1990, now abandoned, which is a continuation of application Ser. No. 363,471, filed Jun. 8, 1989, now abandoned.

BACKGROUND OF THE INVENTION

This invention relates to mounts for removably supporting artwork, photographs and similar flat articles on a support medium.

One of the most commonly used means for removably mounting artwork or photographs on a backing board or overmat are pocket-like corner mounts which receive the corners of the artwork or photograph and are adhesively attached to a backing board or overmat. Such a mounting system does not prevent buckling of the artwork and can actually promote buckling when the corner mounts restrict natural expansion due to heat and humidity.

Another mounting means includes two strips of heavy weight paper including a layer of adhesive covered by a peel-off sheet. A first strip is mounted on the backing board or overmat next to an edge of the art work or photograph and a second strip is mounted on top of the first strip so that a portion overlaps the periphery of the artwork or photograph to hold it in place. In addition to requiring two separate parts, artwork or photographs thinner than the mounting strips can slide in the resulting mounts.

SUMMARY OF THE INVENTION

An object of the invention is to provide a simple, inexpensive mount for removably supporting artwork, photographs and similar flat articles on a support medium.

Another object of the invention is to provide such a mount which can hold the article firmly in place and yet allow for natural expansion due to heat and humidity.

A further object of the invention is to provide such a mount which can be used for prolonged periods of time without causing damage or discoloration to artwork.

Other objects, aspects and advantages of the invention will become apparent to those skilled in the art upon reviewing the following detailed description, the drawing and the appended claims.

The invention provides a mount for removably supporting artwork, photographs and similar flat articles on a support medium, such as a backing board or print mat, comprising an elongated strip of heavyweight, non-acidic paper having inner and outer surfaces, a longitudinally extending score line for facilitating folding in the outer surface and dividing the strip into a stationary section and a foldable section, and a film of adhesive on the inner surface of the stationary section for attaching the stationary section to a support medium. The foldable section can be folded over to form a pocket for snugly receiving an edge of the article. This pocket firmly clamps the article when installation of a frame is completed.

The adhesive preferably is non-acidic and is covered with a peel-off sheet which is removed to expose the adhesive just prior to mounting. The strip preferably is made from a paper having a neutral pH so as not to cause discoloration or damage to artwork and most preferably is a rag cotton material.

DETAILED DESCRIPTION

The mount of the invention can be used to removably support a variety of flat sheet articles to a support medium. It is particularly adaptable for removably supporting artwork on a backing board or print mat and will be described in connection with that application.

Figure 1:
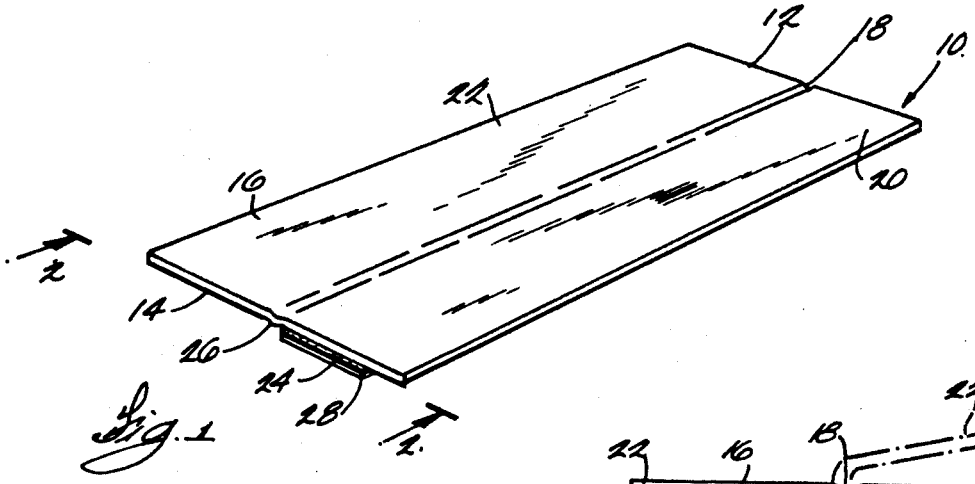
FIG. 1 is a perspective view of a mount in accordance with the invention.

Illustrated in FIG. 1 is a mount 10 of the invention. The mount 10 is made from an elongated strip 12 of heavyweight, non-acidic paper and has an inner surface 14, an outer surface 16 and a longitudinally extending score line 18 dividing the strip 12 into a stationary section 20 and a foldable section 22. The score line 18 facilitates folding of the foldable section 22 toward the stationary section 20 as illustrated by the dashed lines in FIG. 2.

The mount 10 also includes a thin strip or film 24 of an adhesive 26 on the inner surface 14 of the stationary section 20 spaced laterally from and extending generally parallel to the score line 18, preferably substantially along the entire length of the stationary section 20. The adhesive film 26 preferably is protected by a peel-off cover or sheet 28.

To minimize potential damage to or discoloration of artwork and permit long-term archival use, the strip 12 preferably is made from a paper which has a neutral pH, such as a cotton rag paper material, most preferably which is substantially 100% cotton rag. The adhesive film 26 preferably is non-acidic and can be applied to the inner surface 14 of the stationary section 20 in any suitable manner. In a preferred embodiment, the adhesive is applied in the form of a double-coated splicing tape including a polyester film coated on both sides with an acrylic adhesive having a pH of 7 or greater and a silicone coated release paper covering the adhesive. This tape is cut to the proper length, the release paper peeled off one side and the tape applied to the inner 14 surface of the stationary section 20. A suitable commercially available double-coated splicing tape is Polyken 126 marketed by the Polyken Division of The Kendall Company, Boston, Mass. This tape has a total thickness of 3.5 mills.

Figure 2:
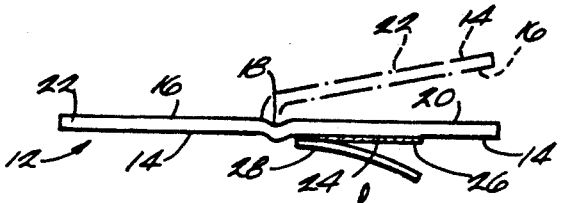
FIG. 2 is an enlarged in view taken generally along line 2—2 in FIG. 1 showing the mount in a folded condition and a partially folded condition.
Figure 3:
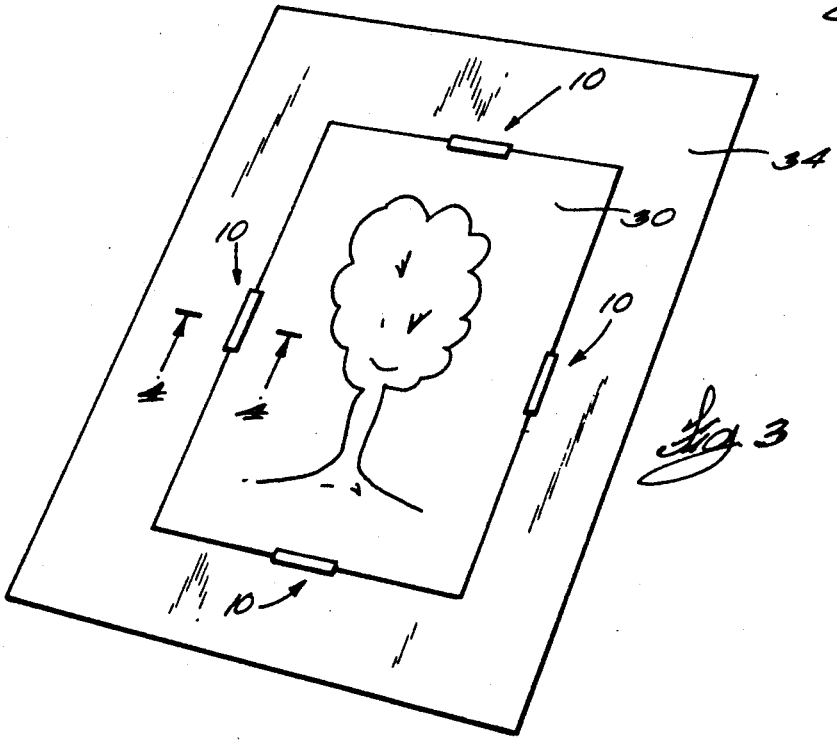
FIG. 3 is a perspective view of a backing board and a piece of artwork removably supported thereon with four of the mounts illustrated in FIG. 1.
Figure 4:
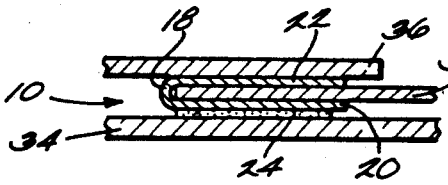
FIG. 4 is an enlarged view taken generally along line 4—4 in FIG. 3 after an overmat has been installed.

FIGS. 2–4 illustrate how four mounts 10 are used to removably support a piece of artwork 30 on a backing board 34. The artwork 30 is positioned on the backing board 34 and the mounts 10 are secured to the backing board 34 at the midpoints of the top, bottom and opposite sides of the artwork 30. Prior to attachment, each mount 10 is folded in half along the score line 18 as illustrated by the dashed lines in FIG. 2 and the cover sheet 28 is peeled off. For the top and bottom of the artwork 30, mounts 10 are secured to the backing board at locations such that the artwork 30 fits snugly into the folds of the opposed mounts 10. For the two sides, the mounts 10 are secured to the backing board 34 at locations such that there is a small gap (e.g., 1/16 inch) between the folds and the edge of the artwork 30 to allow for expansion. For larger artwork, additional mounts spaced at about 5–6 inch intervals can be used.

After the mounts have been secured to the backing board 34, an overmat 36 (illustrated fragmentarily in FIG. 4) is placed over the outer peripherial portion of the artwork 30 and the artwork is ready for framing. The frame compresses the overmat 36 against the foldable section 22 of the mount 10 which firmly clamps the outer peripheral portion of the artwork and thereby minimizes slippage. To remove the artwork 30, the mounts 10 simply are unfolded after the overmat 36 has been moved away from the mounts 10.

Figure 5:
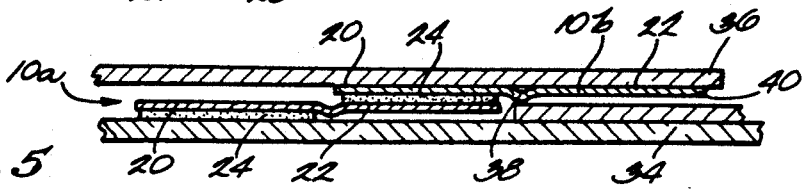
FIG. 5 is a view similar to FIG. 4 showing an alternate mounting scheme.

FIG. 5 illustrates an alternate mounting scheme in which a first unfolded mount 10*a* is mounted on the backing board 34 with an edge 38 next to or against the edge of the artwork 30. A second unfolded mount 10*b* is secured on the top of the first mount 10*a* with a portion 40 of the foldable section 22 overlapping the peripheral portion of the artwork 30.

From the foregoing description, one skilled in the art can easily ascertain the essential characteristics of the invention and, without departing from the spirit and scope thereof, make various changes and modifications to adapt it to various usages.

I claim:

1. A method for removably mounting artwork, photographs and other similar flat articles having a perimeter and corners on a support medium comprising the steps of providing mounts including an elongated strip of heavyweight, non-acidic paper having an inner surface, an opposed outer surface, opposed edges and a longitudinal score line in the outer surface extending along a length of said strip and generally parallel to one of said edges for folding the strip and dividing it into a stationary section having inner and outer surfaces and a foldable section having inner and outer surfaces, placing a film of adhesive on the inner surface of the stationary section for securing the stationary section to a support medium placing and a peel-off sheet over the adhesive;

folding each of the mounts along the score line with the outer surfaces of the foldable and stationary sections facing each other to form a longitudinally extending folded over section open at both ends for receiving a peripheral portion of the article to be mounted;

removing the peel-off sheet from each mount before or after said folding; and adhering a plurality of the mounts to the support medium at spaced locations around the perimeter of the article other than the corners with the stationary section extending beneath the article and the foldable section overlapping the article.

2. A method according to claim 1 wherein the article includes top, bottom and side edges;

at least one of the mounts is used for each of the article edges; and before adhering the mounts to the support medium, the top and bottom edges of the article are fitted snuggly into the folded over section of a respective mount and the side edges are spaced a small distance from the fold of the respective mount.

3. A method according to claim 2 wherein said adhesive is non-acidic.

4. A method according to claim 1 wherein said paper has a neutral pH.

5. A method according to claim 4 wherein said paper is a rag cotton paper material.

6. A method according to claim 5 wherein the paper is substantially 100% rag cotton.

* * * * *

UNITED STATES PATENT AND TRADEMARK OFFICE

CERTIFICATE OF CORRECTION

PATENT NO. : 5,226,996

DATED : July 13, 1993

INVENTOR(S) : Vicki Z. Schober

It is certified that error appears in the above-indentified patent and that said Letters Patent is hereby corrected as shown below:

Column 2, line 58, "mills" should read ---mils---;

Column 3, line 34, after "of", insert ---:---;

Column 4, line 7, after "medium", delete "placing";

Column 4, line 7, after "and", insert ---placing---.

Signed and Sealed this

Twenty-ninth Day of March, 1994

*Attest:*

Bruce Lehman

BRUCE LEHMAN

*Attesting Officer*

*Commissioner of Patents and Trademarks*